US010507899B2

(12) United States Patent
Imamura et al.

(10) Patent No.: US 10,507,899 B2
(45) Date of Patent: Dec. 17, 2019

(54) MOTION CONTROL DEVICE AND MOTION CONTROL METHOD FOR SHIP

(71) Applicant: Mitsubishi Electric Corporation, Tokyo (JP)

(72) Inventors: Naoki Imamura, Tokyo (JP); Ryo Sakaguchi, Tokyo (JP); Norihiko Mouri, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 27 days.

(21) Appl. No.: 15/876,279

(22) Filed: Jan. 22, 2018

(65) Prior Publication Data

US 2018/0290719 A1 Oct. 11, 2018

(30) Foreign Application Priority Data

Apr. 10, 2017 (JP) ..... 2017-077393

(51) Int. Cl.
*B63J 99/00* (2009.01)
*B63H 21/21* (2006.01)
(Continued)

(52) U.S. Cl.
CPC ..... *B63J 99/00* (2013.01); *B63H 20/12* (2013.01); *B63H 21/21* (2013.01); *B63H 2020/003* (2013.01); *B63J 2099/006* (2013.01)

(58) Field of Classification Search
CPC ..... B63J 99/00; B63H 20/08; B63H 21/21; B63H 20/00; B63H 25/42; B63H 21/22
See application file for complete search history.

(56) References Cited

U.S. PATENT DOCUMENTS

2005/0245145 A1* 11/2005 Takada ..... B63H 20/00 440/1
2006/0105647 A1* 5/2006 Yazaki ..... B63H 21/213 440/53

(Continued)

FOREIGN PATENT DOCUMENTS

JP 2001-219899 A 8/2001
JP 2001219899 A * 8/2001

(Continued)

OTHER PUBLICATIONS

Communication dated Feb. 6, 2018 from the Japanese Patent Office in counterpart application No. 2017-077393.

*Primary Examiner* — Yuri Kan
(74) *Attorney, Agent, or Firm* — Sughrue Mion, PLLC; Richard C. Turner

(57) ABSTRACT

To provide a motion control device for a ship, which does not require adjustment of weights of an performance function, and is less liable to fail in control calculation by building optimization calculation only into a part of classical feedback control, the motion control device, which is configured to cause a ship, on which a plurality of outboard engines are installed, to cruise along a desired trajectory, includes: a trajectory generator configured to output a trajectory command; a controller configured to output a control force command based on the trajectory command and a sensor information group output from a sensor group provided for the ship; and a control force distributor configured to carry out, based on the control force command, optimization calculation for operation amounts required for the plurality of outboard engines in accordance with a constraint condition set in advance so as to output the operation amounts.

6 Claims, 8 Drawing Sheets

(51) Int. Cl.

| | |
|---|---|
| ***B63H 21/22*** | (2006.01) |
| ***B63H 20/12*** | (2006.01) |
| *B63H 20/00* | (2006.01) |

(56) References Cited

U.S. PATENT DOCUMENTS

| | | | | |
|---|---|---|---|---|
| 2012/0231680 | A1* | 9/2012 | Ono | B63H 21/21 440/1 |
| 2014/0220837 | A1* | 8/2014 | Kuriyagawa | B63H 21/21 440/1 |

FOREIGN PATENT DOCUMENTS

| | | | | | |
|---|---|---|---|---|---|
| JP | 2004-042885 | A | | 2/2004 | |
| JP | 2004042885 | A | * | 2/2004 | B63H 25/42 |

* cited by examiner

TIME HISTORY OF SHIP BEHAVIOR

TIME HISTORY OF OUTBOARD ENGINE OPERATION AMOUNT

MOTION CONTROL DEVICE AND MOTION CONTROL METHOD FOR SHIP

BACKGROUND OF THE INVENTION

1. Field of the Invention

The present invention relates to a motion control device and a motion control method for a ship, for causing a ship provided with outboard engines to cruise along a desired trajectory.

2. Description of the Related Art

In a related-art motion control device for a ship, there are known a propulsion force distribution method and a propulsion force distribution device, for highly precisely controlling generated propulsion forces for implementing motion control functions, such as navigation from an initial position to a target position and dynamic positioning, in a ship provided with a plurality of azimuth thrusters and bow thrusters (e.g., Japanese Patent Application Laid-open No. 2004-042885 (lines 1 to 28 on page 9, FIG. 7 and FIG. 8)).

In Japanese Patent Application Laid-open No. 2004-042885, balance relationships of a resultant force and a resultant moment of the propulsion forces are set in advance in consideration of non-linearity and dynamic characteristics of each of three propulsion force generation devices. Further, after an performance function is defined, a propeller propulsion force, a steering angle, and a steering angle speed of each of the propulsion generation devices are calculated through model predictive control of minimizing the generated propulsion force of each of the propulsion force generation devices while the balance relationships of the resultant force and the resultant moment are set as constraint conditions.

However, in the related-art propulsion force distribution device of the motion control device for a ship, there is problem in that weights of the defined performance function are adjusted on a trial-and-error basis, and thus optimal adjustment of the weights takes time. Moreover, the model predictive control has a problem in that a control system fails when the optimization calculation is not completed within a prediction time section or horizon set in advance.

SUMMARY OF THE INVENTION

The present invention has been made in order to solve the above-mentioned problems, and therefore has an object to provide a motion control device and a motion control method for a ship, which do not require adjustment of weights of an performance function, and is less liable to fail in control calculation by building optimization calculation only into a part of feedback control to which a classical control system, for example, PID control, is applied.

According to one embodiment of the present invention, there is provided a motion control device for a ship, which is configured to cause a ship, on which a plurality of outboard engines are installed, to cruise along a desired trajectory, the motion control device including: a trajectory generator configured to output a trajectory command; a controller configured to output a control force command based on the trajectory command and a sensor information group output from a sensor group provided for the ship; and a control force distributor for carrying out, based on the control force command, optimization calculation for operation amounts required for the plurality of outboard engines in accordance with a constraint condition set in advance so as to output the operation amounts. According to one embodiment of the present invention, there is also provided a motion control method for a ship.

According to the present invention, it is possible to provide the motion control device and the motion control method for a ship, which do not require the adjustment of the weights of the performance function, and is less liable to fail in the control calculation by building the optimization calculation only into the part of the feedback control to which the classical control system, for example, the PID control, is applied.

DESCRIPTION OF THE EMBODIMENTS

Now, a motion control device and a motion control method for a ship according to each of embodiments of the present invention are described with reference to the drawings. In each of the embodiments, the same or corresponding portions are denoted by the same reference symbols, and the overlapping description thereof is omitted.

First Embodiment

Figure 1:
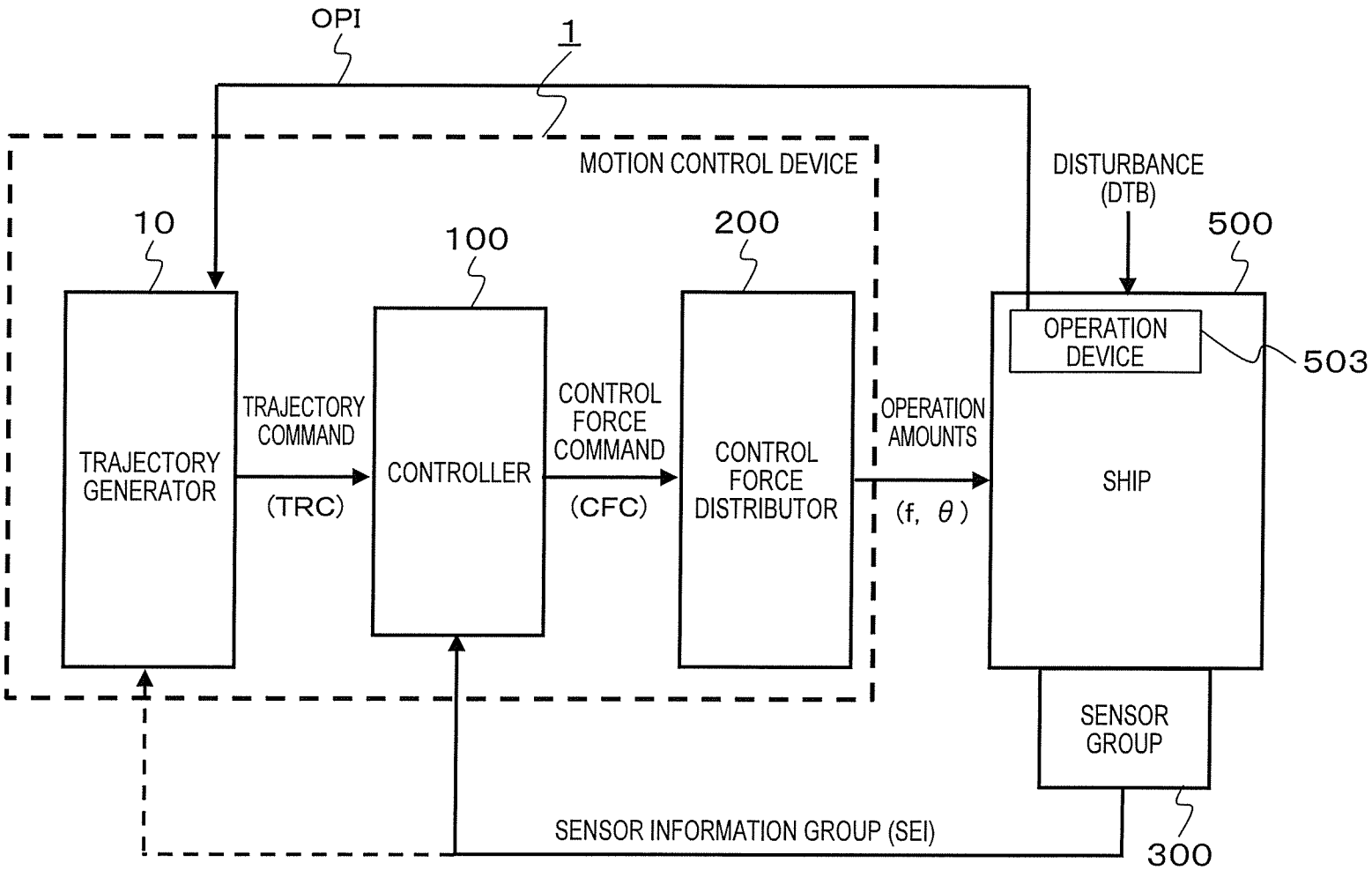
FIG. 1 is an overall configuration diagram for illustrating an example of a ship control system including a motion control device for a ship according to an embodiment of the present invention.

FIG. 1 is an overall configuration diagram for illustrating an example of a ship control system including the motion control device for a ship according to an embodiment of the present invention. FIG. 1 is a diagram for illustrating a relationship among a ship to be controlled, a sensor group, and the motion control device for a ship. Basically, the ship is provided with outboard engines (not shown), which are actuators for controlling front/rear and left/right translational motions or an azimuth angle of the ship. The outboard engine includes a propulsion force generation mechanism (not shown) for providing a propulsion force to a hull, and a steering mechanism (not shown) for turning a rudder, and the propulsion force and the steering angle of each outboard engine are controlled based on operation amounts, which are outputs of a motion control device 1 for a ship.

As a propulsion and steering mechanism for a ship, there is known an outboard engine often seen in a small ship, in which a main part including a screw provided under the engine and integrally therewith is mounted on an outside of a hull, and which is configured to change a direction of the main part in order to change a direction of the ship. The ship to be controlled in the present invention is not limited to such a small ship, and also includes a ship including a propulsion and steering mechanism often seen in a large ship, in which a driving part, for example, an engine, is provided inboard and a screw part variable in a direction is exposed to the outside of the ship as an outboard engine.

In the following, the outboard engine includes outboard engines having any of the above-mentioned configurations.

Moreover, the ship is provided with a sensor group 300 for detecting a motion state of the ship. The sensor group 300 is constructed by, for example, the global positioning system (GPS) configured to measure the longitude and latitude of the ship and a magnetic azimuth sensor configured to measure the azimuth angle of the ship. However, the configuration of the sensor group 300 is not limited to a specific configuration, and the sensor group 300 may include a so-called publicly-known inertial navigation device including a gyro configured to measure an angular velocity of the ship, and an acceleration sensor configured to measure a translational acceleration of the ship, and other such sensors. In the following, for the sake of a clear description of the configuration of the motion control device 1 for a ship, it is assumed that two outboard engines are installed on a ship 500, for example.

The motion control device 1 for a ship includes a trajectory generator 10, a controller 100, and a control force distributor 200. A detailed description is now given of functions together with inputs/outputs of each of the trajectory generator 10, the controller 100, and the control force distributor 200 included in the motion control device 1 for a ship.

Figure 2:
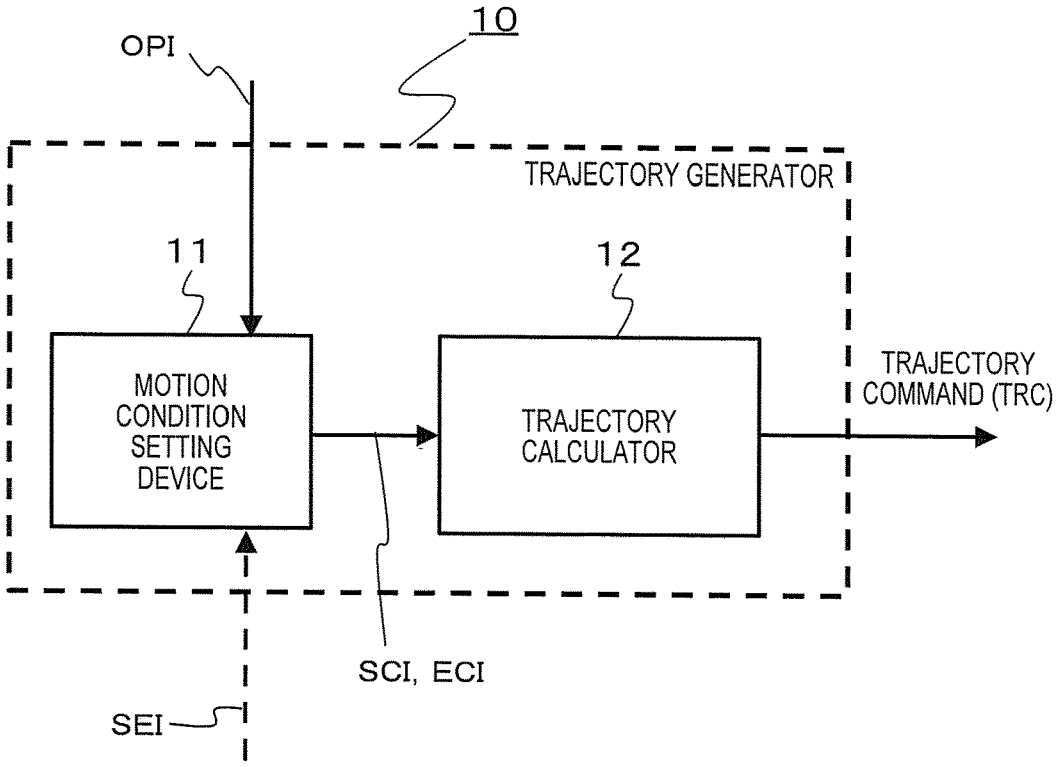
FIG. 2 is a diagram for illustrating an example of a configuration of a trajectory generator of FIG. 1 in a first embodiment of the present invention.

First, in FIG. 2, an example of a configuration of the trajectory generator 10 of FIG. 1 in the first embodiment of the present invention is illustrated. The trajectory generator 10 includes a motion condition setting device 11 and a trajectory calculator 12. The motion condition setting device 11 is configured to set an initial condition and a terminal condition of the motion of the ship. An operator of the ship 500 gives an operation input OPI to set through, for example, an operation device 503, which is a user interface of the ship 500, an initial state before start of the motion of, for example, a position, an attitude angle, an angular velocity, an acceleration, and an angular acceleration, and a terminal state thereof when a desired motion is completed. When the operator desires to operate the ship from an intended initial state to an intended terminal state, the setting may be given by values of the position, the attitude angle, the angular velocity, the acceleration, and the angular acceleration in a numerical form. Moreover, recently, a user interface for the GPS has often been configured as a touch panel, and hence the initial state is always monitored as a sensor information group SEI based on detected values of the sensor group 300. Accordingly, the initial state is automatically known, and the terminal state may thus be simply given through touch input on a user interface screen.

Then, the trajectory calculator 12 receives an initial state SCI and a terminal state ECI output by the motion condition setting device 11, and calculates a profile of specific trajectory commands TRC. A plurality of calculation methods for the profile of the trajectory commands TRC are conceivable. For example, a trajectory given by a polynomial of a time t is calculated based on the position, the attitude angle, the velocity, the angular velocity, the acceleration, and the angular acceleration in the initial state SCI and the terminal state ECI of the ship, which are obtained by the motion condition setting device 11, and the resultant trajectory commands TRC are output.

For the calculation of the profile of the trajectory commands, in addition to the above-mentioned method, the trajectory may be calculated as a straight line trajectory connecting the initial state SCI and the terminal state ECI to each other in the minimum period, or may be calculated as a trajectory between the initial state and the terminal state reachable with the minimum fuel. In other words, for the transition from the initial state to the terminal state, an optimal trajectory that minimizes an performance function set in advance, for example, an optimal trajectory in terms of the minimum period or the optimal trajectory in terms of the minimum fuel, may be calculated.

Figure 3:
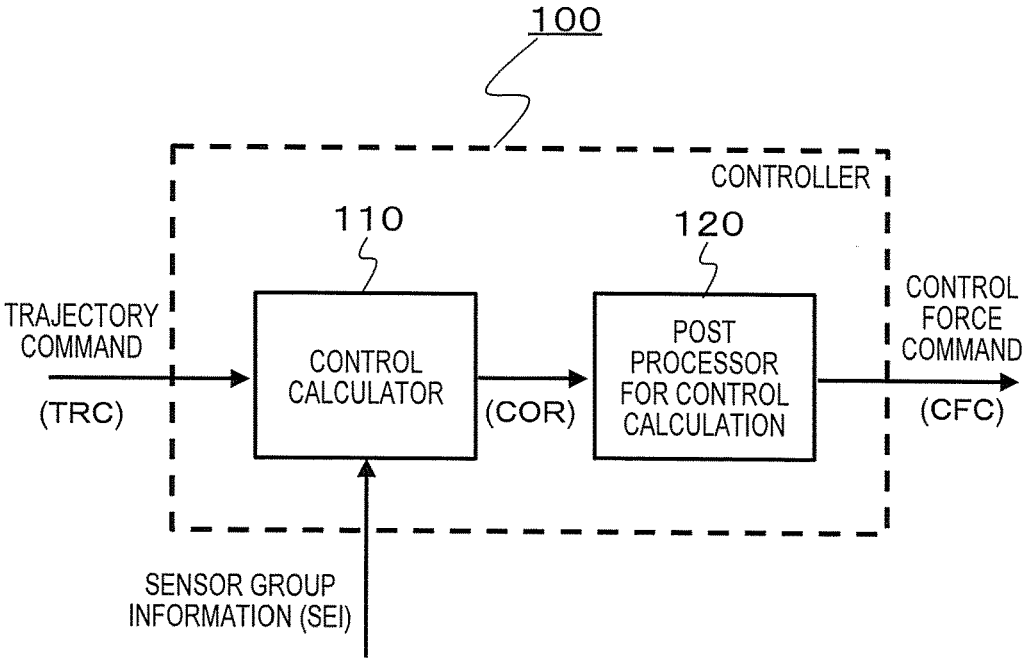
FIG. 3 is a diagram for illustrating an example of a configuration of a controller of FIG. 1 in the first embodiment of the present invention.

Next, in FIG. 3, an example of a configuration of the controller 100 of FIG. 1 in the first embodiment of the present invention is illustrated. The controller 100 includes a control calculator 110 and a post processor 120 for control calculation. The control calculator 110 is configured to output control force commands CFC in accordance with publicly-known PID control based on the trajectory commands TRC, which are the outputs of the trajectory generator 10, and the sensor information group SEI, which is the output of the sensor group 300. On this occasion, as a configuration of a PID control system, PID calculation may be carried out based on differences between the trajectory commands TRC and the sensor information group SEI, for example. Moreover, the configuration of the PID control system may be PI-D control, which carries out calculation of multiplying, by a gain, a difference between a speed command equivalence obtained by carrying out PI calculation based on the difference between the trajectory command TRC and the sensor information group SEI and an actual speed obtained as a time derivative of the sensor information group. In other words, a configuration of all types of the PID control in the classical control theory can be applied as the configuration of the PID control system.

Moreover, as preprocessing for a difference signal representing the difference, dead zone processing of setting the difference to zero in a section set in advance in which the difference is small may be applied, for example.

The post processor 120 for control calculation is provided at a subsequent stage of the control calculator 110, and is configured to carry out processing of restricting upper/lower limits of the signal and a change rate of the signal for a control calculation result COR output by the control calculator 110, and output the control force commands CFC.

Figure 4:
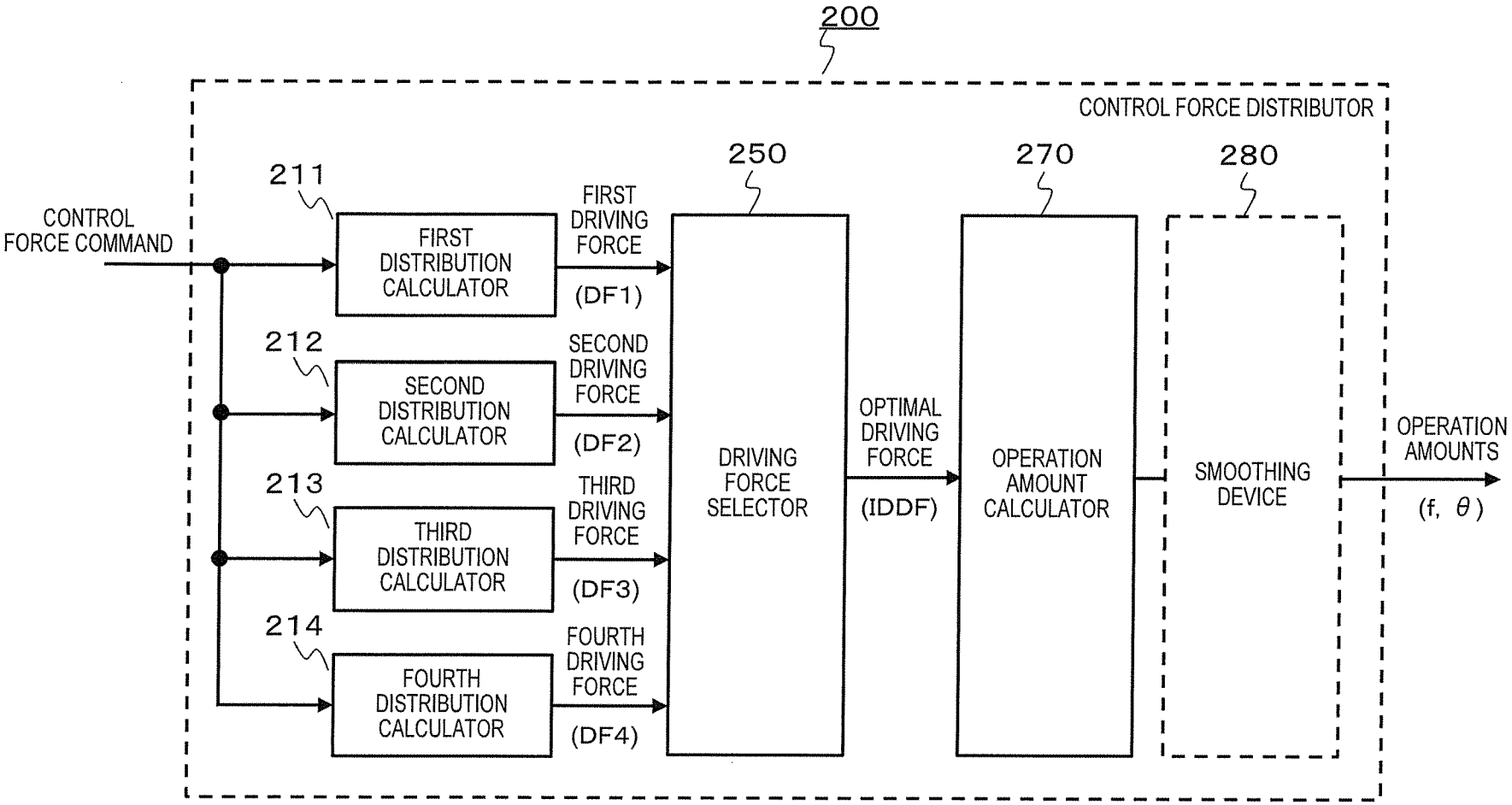
FIG. 4 is a diagram for illustrating an example of a configuration of a control force distributor of FIG. 1 in the first embodiment of the present invention.
Figure 5:
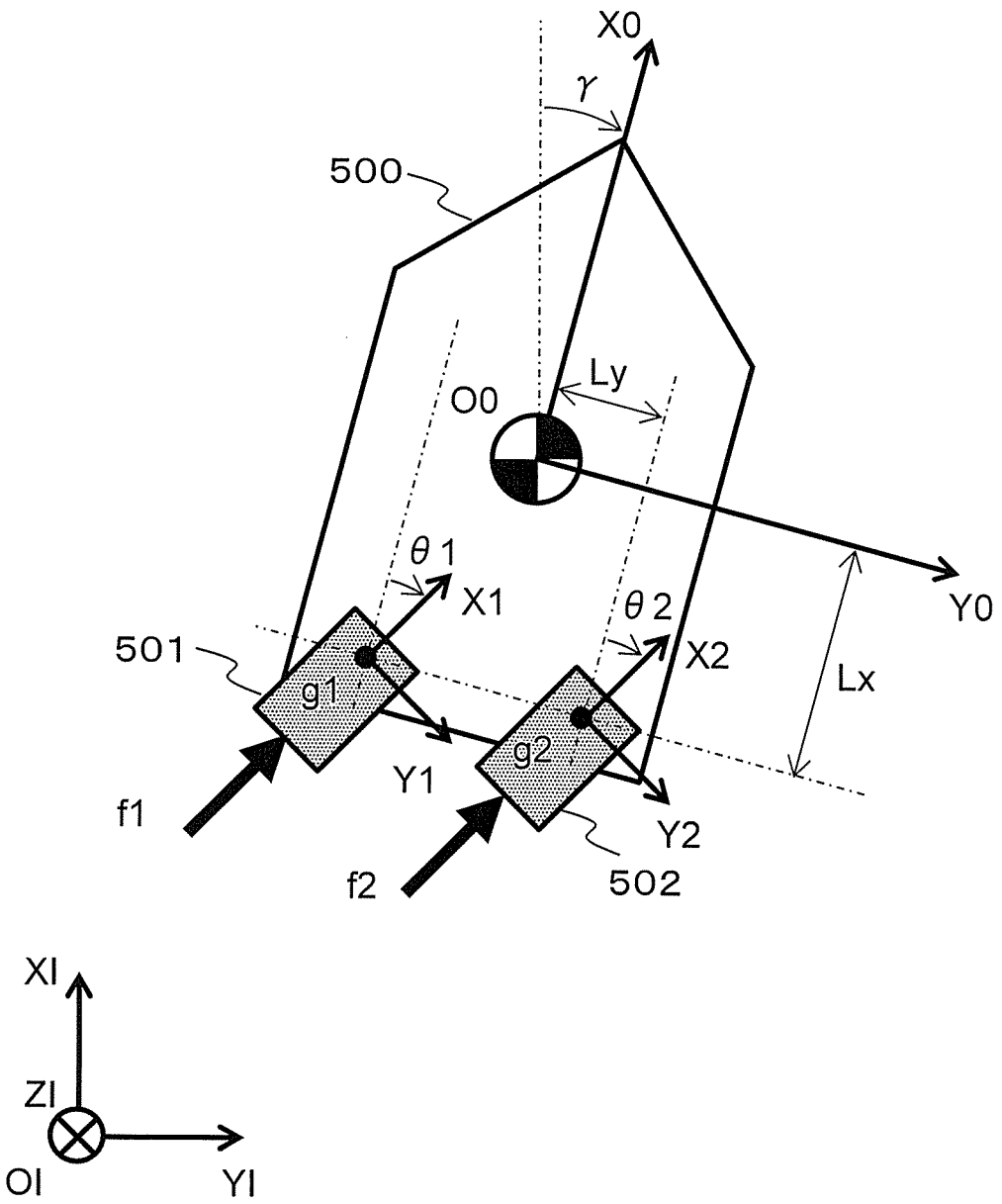
FIG. 5 is a schematic diagram for illustrating a motion of a ship recognized as an X-axis direction translation (surge), a Y-axis direction translation (sway), and a Z-axis direction rotation (yaw).

Next, in FIG. 4, an example of a configuration of the control force distributor 200 of FIG. 1 in the first embodiment of the present invention is illustrated. The control force distributor 200 includes a first distribution calculator 211, a second distribution calculator 212, a third distribution calculator 213, a fourth distribution calculator 214, a driving force selector 250, and an operation amount calculator 270. Referring also to FIG. 5, a detailed description is now given of those modules.

FIG. 5 is a schematic diagram for illustrating the motion of the ship recognized as an X-axis direction translation (surge), a Y-axis direction translation (sway), and a Z-axis direction rotation (yaw). The motion of the ship usually has a total of six degrees of freedom of the motion, which are three degrees of freedom of the translation and three degrees of freedom of the rotation. However, the motion of FIG. 5 is a schematic motion recognized as a plane motion having a total of three degrees of freedom of the motion in which a Z-axis direction translation (heave), an X-axis direction rotation (roll), and a Y-axis direction rotation (pitch) are neglected, and an X axis translation (surge), a Y-axis direction translation (sway), and a Z-axis direction rotation (yaw) are considered.

On this occasion, for example, the Z-axis direction rotation means rotation about the Z axis as its rotation axis.

In FIG. 5, a coordinate system OI-XIYIZI is a right-handed inertial coordinate system having OI as the origin, and a coordinate system O0-X0Y0Z0 is a right-handed body-fixed coordinate system having O0 as the origin.

In other words, in the inertial coordinate system, for example, XI axis is set to an axis along a longitude line of the earth, and YI axis is set to an axis along a latitude line of the earth. In the body-fixed coordinate system, the X0 axis is an axis connecting the bow and the stern of the ship 500 to each other, and the Y0 axis is an axis orthogonal to the X0 axis in the horizontal plane.

Distances from the origin OI of the inertial coordinate system OI-XIYIZI to the origin O0 of the body-fixed coordinate system O0-X0Y0Z are set as X and Y, and an angle between the XI axis of the inertial coordinate system OI-XIYIZI and the X0 axis of the body-fixed coordinate system O0-X0Y0Z is set as an azimuth angle γ. It is assumed that the origin O0 matches the center of gravity of the ship.

Two outboard engines 501 and 502 are installed on the ship 500 as described above, and the propulsion forces of the outboard engines 501 and 502 are represented by $f_1$ and $f_2$, respectively. The symbols $g_1$ and $g_2$ represent rotation centers of outboard engine steering, and when a right-handed body-fixed coordinate system 01-X1Y1Z1 and a right-handed body-fixed coordinate system 02-X2Y2Z2 having the respective rotation centers as the centers are defined, a 0 reference of each of the steering angles is a case in which the X0 axis and the X1 axis or the X0 axis and the X2 axis are parallel with each other and match in the direction. On this occasion, respective steering angles of the outboard engines 501 and 502 are a relative angle $\theta_1$ between the X0 axis and the X1 axis and a relative angle $\theta_2$ between the X0 axis and the X2 axis. With the above-mentioned preparation, a motion equation of the ship 500 is given by Expression (1).

$$\begin{cases} (m_0 + m_X)(\dot{v}_{X0} - \dot{\gamma} v_{Y0}) = f_1\cos(\theta_1) + f_2\cos(\theta_2) + X_d \\ (m_0 + m_Y)(\dot{v}_{Y0} + \dot{\gamma} v_{X0}) = f_1\sin(\theta_1) + f_2\sin(\theta_2) + Y_d \\ (I_{Z0} + J_Z)\ddot{\gamma} = f_1 L_y\cos(\theta_1) - f_1 L_x\sin(\theta_1) - \\ \quad f_2 L_y\cos(\theta_2) - f_2 L_x\sin(\theta_2) + N_d \end{cases} \tag{1}$$

The symbols in Expression (1) are defined as follows.

$m_0$: Mass of the ship $m_x$, $m_y$: Added masses caused by the X-axis direction translational motion and the Y-axis direction translational motion of the ship $I_{z0}$: Moment of inertia about the center of gravity of the ship $J_z$: Added moment of inertia caused by a Z-axis direction rotational motion (i.e., motion about the ship center of gravity) of the ship $v_{x0}$, $v_{y0}$: X-axis direction speed and the Y-axis direction speed of the ship based on the body-fixed coordinate system O0-X0Y0Z0

$L_x$, $L_y$: Distances (≥0) in the X-axis direction and the Y-axis direction from the center of gravity of the ship to the rotation center of each of the outboard engines $X_d$, $Y_d$, $N_d$: X-axis direction translational disturbance, Y-axis direction translational disturbance, and Z-axis direction rotational disturbance of the ship (collectively referred to as disturbance DTB illustrated in FIG. 1)

$f_1$, $f_2$: Propulsion forces required for the outboard engines 501 and 502

A dot (˙) above each symbol represents a time derivative, and dots (¨) above each symbol represent a second-order time derivative.

Terms other than each of $X_d$, $Y_d$, and $N_d$ on each of the right sides of Expression (1) correspond to control force commands CFC for causing the ship to carry out a desired motion, and when control force commands are represented by $X_f$, $Y_f$, and $N_f$, the control force commands $X_f$, $Y_f$, and $N_f$ may be expressed as Expression (2).

$$\begin{bmatrix} X_f \\ Y_f \\ N_f \end{bmatrix} = \begin{bmatrix} 1 & 0 & 1 & 0 \\ 0 & 1 & 0 & 1 \\ L_y & -L_x & -L_y & -L_x \end{bmatrix} \begin{bmatrix} f_1\cos(\theta_1) \\ f_1\sin(\theta_1) \\ f_2\cos(\theta_2) \\ f_2\sin(\theta_2) \end{bmatrix} = C \begin{bmatrix} f_{X1} \\ f_{Y1} \\ f_{X2} \\ f_{Y2} \end{bmatrix} \tag{2}$$

The expression in Expression (2) uses the following simplified notation.

$$C \equiv \begin{bmatrix} 1 & 0 & 1 & 0 \\ 0 & 1 & 0 & 1 \\ L_y & -L_x & -L_y & -L_x \end{bmatrix}$$

$$\begin{bmatrix} f_1\cos(\theta_1) \\ f_1\sin(\theta_1) \\ f_2\cos(\theta_2) \\ f_2\sin(\theta_2) \end{bmatrix} \equiv \begin{bmatrix} f_{X1} \\ f_{Y1} \\ f_{X2} \\ f_{Y2} \end{bmatrix}$$

The symbols of the expressions are defined as follows.

$f_{X1}$: Propulsion force operation amount in the X-axis direction directed to the outboard engine 501

$f_{Y1}$: Propulsion force operation amount in the Y-axis direction directed to the outboard engine 501

$f_{X2}$: Propulsion force operation amount in the X-axis direction directed to the outboard engine 502

$f_{Y2}$: Propulsion force operation amount in the Y-axis direction directed to the outboard engine 502

$f_{max}$: Restriction value of the propulsion force operation amount Expression (2) represents that the X-axis direction translational force command $X_f$, the Y-axis direction translational force command $Y_f$, and the Z-axis direction rotational torque command $N_f$, which are the three control force commands CFC from the controller 100, are distributed to two operation amounts, which are the propulsion force and the steering angle per one outboard engine, for the two outboard engines, that is, distributed to a total of four operation amounts.

Incidentally, actuators more than the number of degrees of freedom of motion are often installed on a moving body, for example, a ship, in consideration of hardware failure or the like. In this case, the number of actuators is larger than the number of the control commands, and the distribution of the control command group to the actuator group is not uniquely determined. This problem is well known as control allocation problem.

The control force distributor 200 of the present invention substantially outputs the four distributed operation amounts from the three control force commands, in particular, distributes the operation amounts while constraint conditions set in advance, for example, steering angle constraint and propulsion force constraint, are satisfied. A description is now given of a specific control distribution problem thereof.

Figure 6:
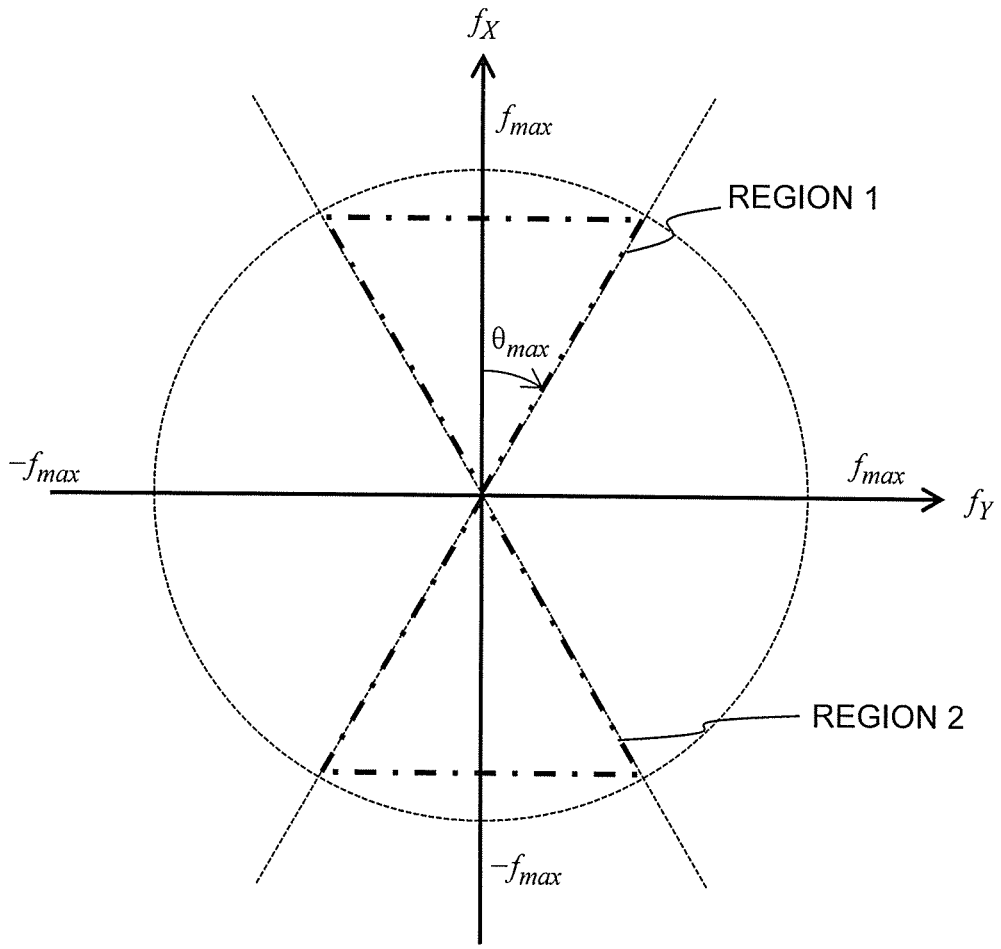
FIG. 6 is a diagram for illustrating a two-dimensional plane and constraint regions with the vertical axis indicating a propulsion force operation amount in an X-axis direction and the horizontal axis indicating a propulsion force operation amount in a Y-axis direction in the first embodiment of the present invention.

FIG. 6 is a diagram for illustrating a two-dimensional plane and constraint regions with the vertical axis indicating the propulsion force operation amount in the X-axis direction and the horizontal axis indicating the propulsion force operation amount in the Y-axis direction. Upper/lower limits of the propulsion force that can be generated by the one outboard engine are represented by $\pm f_{max}$, and upper/lower limits of the steering angle is represented by $\pm\theta_{max}$. In this case, a constraint condition relating to the propulsion force operation amounts is given by Expression (3).

$$f_{Xi}^2+f_{Yi}^2\leq f_{max}^2\ (i=1,2) \tag{3}$$

In this expression, a suffix i is a number for discriminating the two outboard engines from each other. In the following, the outboard engine 501 is also referred to as outboard engine (1), and the outboard engine 502 is also referred to as outboard engine (2).

Expression (3) means that the propulsion constraint of the outboard engine is represented as a nonlinear inequality constraint condition. Moreover, when the upper/lower limits$\pm\theta_{max}$ of the steering angle is considered, sectors symmetrical about the $f_Y$ axis are feasible regions, but this also corresponds to a non-linear inequality constraint condition. Optimization calculation under a nonlinear inequality constraint condition is generally high in the calculation cost, and is thus not suitable for real-time calculation.

Thus, in order to relax the nonlinear inequality constraint condition to a linear inequality constraint condition, the sectors are changed to triangular feasible regions. Specifically, the triangular feasible regions are a region 1 and a region 2 represented by the dashed-dotted lines of FIG. 6. As an example, when both the operation amounts of the outboard engine (1) and the operation amounts of the outboard engine (2) have optimal solutions in the region 1, linear inequality constraint conditions is expressed as Expression (4).

$$\begin{cases} 0\leq f_{X1}\leq f_{max}\cos\theta_{max} \\ -f_{X1}\tan\theta_{max}\leq f_{Y1}\leq f_{X1}\tan\theta_{max} \\ 0\leq f_{X2}\leq f_{max}\cos\theta_{max} \\ -f_{X2}\tan\theta_{max}\leq f_{Y2}\leq f_{X2}\tan\theta_{max} \end{cases} \tag{4}$$

What is to be considered is that, because the two outboard engines and the two candidates of the feasible region exist, an optimization problem is to be solved under a total of four linear inequality constraint conditions. This is the reason why the distribution calculator configured to receive the control force commands CFC to carry out the calculation is constructed by the total of four distribution calculators in FIG. 4, namely, the first distribution calculator 211, the second distribution calculator 212, the third distribution calculator 213, and the four distribution calculator 214.

Next, the performance function J is given by Expression (5).

$$J=\frac{1}{2}F^TRF-f^TCF \tag{5}$$

The symbols of Expression (5) are expressed as follows.

$$f=\begin{bmatrix} X_f \\ Y_f \\ N_f \end{bmatrix}$$

$$F=\begin{bmatrix} f_{X1} \\ f_{Y1} \\ f_{X2} \\ f_{Y2} \end{bmatrix}$$

R: positive semi-definite matrix $F^T$, $f^T$: transposed matrices of F and f, respectively Elements (also referred to as weights) of the positive semi-definite matrix R in Expression (5) may arbitrarily be selected as long as the condition of the positive semi-definiteness is satisfied. However, this arbitrariness contrarily causes trial and error in adjustment of the weights. Thus, the positive semi-definite matrix R is set to Expression (6).

$$R=C^TC+\rho I \tag{6}$$

The symbols in the expression are defined as follows.

ρ: Very small positive number

I: Unit matrix

ρ may be set to 0.

The positive semi-definite matrix R can be uniquely determined in this way, and thus the resultant performance function does not require the adjustment of the weights.

As a result, the calculation can be formulated into a quadratic programming problem of minimizing the performance function of Expression (5) under the linear inequality constraint conditions of Expression (4).

In other words, a solution $F_k$* for minimizing Expression (5) of the performance function is calculated under the linear inequality constraint conditions of Expression (4). A suffix k is an integer of from 1 to 4.

On this occasion, this quadratic programming problem needs to be numerically solved fast within a control cycle set in advance, and a publicly-known solver disclosed in Matthew Brand, Parallel Quadratic Programming for Image Processing, 18th IEEE International Conference on Image Processing, 2011 can be applied to this high-speed calculation, for example. The solver for fast solving the quadratic programming problem is not limited to the solver disclosed in Matthew Brand, Parallel Quadratic Programming for Image Processing, 18th IEEE International Conference on Image Processing, 2011, but any solver can be used as long as the solver can complete the optimization calculation within the control cycle set in advance.

In this way, a first driving force DF1, a second driving force DF2, a third driving force DF3, and a fourth driving force DF4 can be acquired from the first distribution calculator 211, the second distribution calculator 212, the third distribution calculator 213, and the fourth distribution calculator 214, respectively, based on the control force commands CFC.

A description is now given of the driving force selector 250. The driving force selector 250 is configured to select an optimal driving force IDDF under a set condition set in advance out of the driving forces DF1 to DF4 acquired from the respective distribution calculators 211 to 214. The set condition is given by Expression (7) in a sense of selecting a set condition that minimizes an error of the equality constraint represented by Expression (2), for example.

$$F_{opt}=\min[(f-CF_k^*)^T(f-CF_k^*)]\ (k=1,2,3,4) \tag{7}$$

The symbols in the expression are defined as follows.

$F_{opt}$: Optimal driving force (IDDF) corresponding to the output of the driving force selector 250

$F_k^*$: Same in meaning as the output DFk of each of the distribution calculators A suffix k is a number for discriminating the four distribution calculators 211 to 214 from one another.

A description is now given of the operation amount calculator 270. The operation amount calculator 270 is configured to calculate a required propulsion force operation amount $f_1$ and a required steering angle operation amount $\theta_1$ of the outboard engine (1) and a required propulsion force operation amount $f_2$ and a required steering angle operation amount $\theta_2$ of the outboard engine (2) based on the optimal driving force IDDF, which is the output of the driving force selector 250.

Specifically, the optimal driving force IDDF acquired under the linear inequality constraint conditions of Expression (4) is calculated in accordance with Expression (8).

$$\begin{cases} f_1 = \sqrt{f_{X1}^2 + f_{Y1}^2} \\ \theta_1 = \tan^{-1}(f_{Y1}/f_{X1}) \\ f_2 = \sqrt{f_{X2}^2 + f_{Y2}^2} \\ \theta_2 = \tan^{-1}(f_{Y2}/f_{X2}) \end{cases} \tag{8}$$

The driving forces DF1 to DF4 and the optimal driving force IDDF are the outputs of the distribution calculators 211 to 214 and the output of the driving force selector 250, respectively.

As described above, according to the first embodiment, in a ship, on which a plurality of outboard engines are installed, when the position/attitude control for the X translation direction (surge), the Y translation direction (sway), and the Z rotation direction (yaw) is carried out, the optimal required operation amounts (f, θ) can be distributed to the outboard engines corresponding to the control force commands CFC for the ship.

Moreover, the optimal required operation amounts (f, θ) are acquired as a solution satisfying the propulsion force restriction and the steering angle restriction of the outboard engine, and thus, for example, a mechanical interferences of the outboard engines caused by an incremental steering of the steering angle exceeding the restriction can be positively prevented, thereby implementing appropriated driving control for the outboard engines.

Further, the performance function does not require the adjustment of the weights that can arbitrarily be set, and the optimization calculation is built into only a part of the feedback control to which a so-called classical control system, for example, the PID control, is applied. Thus, the motion control device for a ship that is easy in the control adjustment and is less liable to fail in the control calculation can be acquired.

A description is now given of a numerical simulation example for verifying effectiveness of the first embodiment. In the numerical simulation, the trajectory commands TRC for the X-axis direction translation, the Y-axis direction translation, and the Z-axis direction rotation are appropriately given, and a behavior of the ship corresponding to the trajectory commands TRC and behaviors of the propulsion force operation amounts $f_i$ (i=1, 2) required on this occasion and the required steering angle operation amounts $\theta_i$ (i=1, 2) are represented as time histories.

Figure 7A:
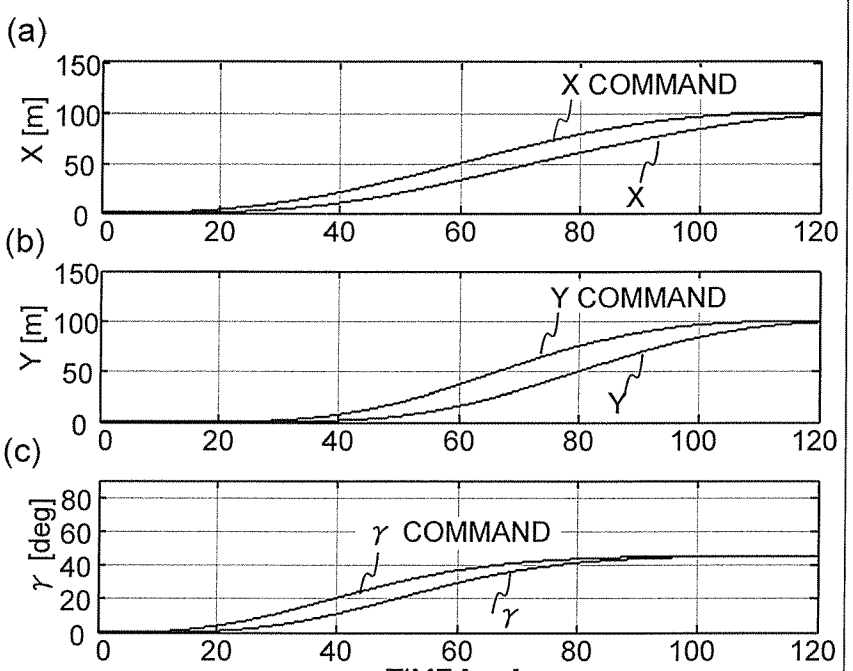
FIG. 7A and FIG. 7B are graphs for showing a behavior of a ship in response to trajectory commands for the X-axis direction translation, the Y-axis direction translation, and the Z-axis direction rotation that are appropriately given, and behaviors of propulsion force operation amounts and steering operation amounts that are required on this occasion in the first embodiment of the present invention.
Figure 7B:
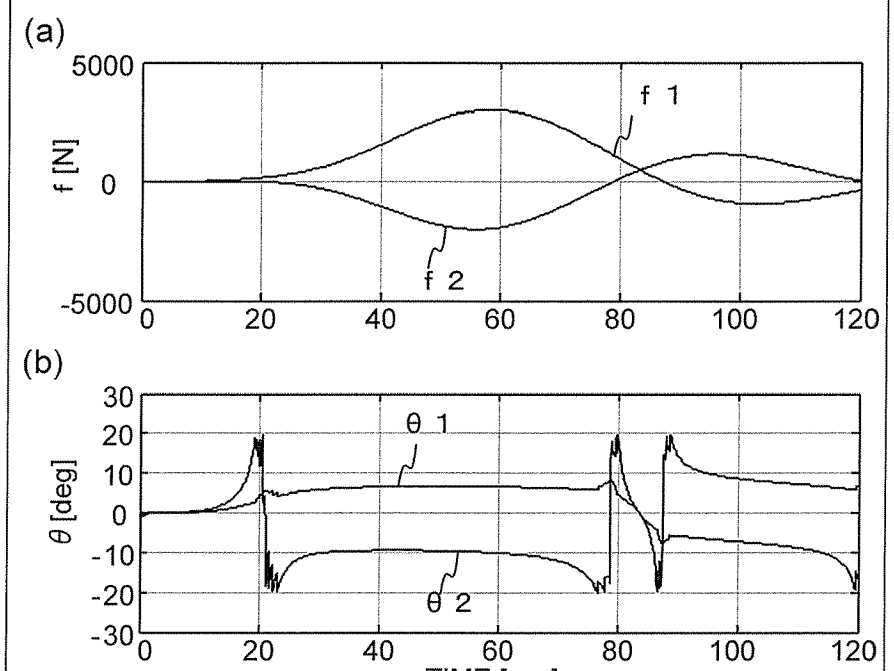

FIG. 7A and FIG. 7B are graphs for showing the behavior of the ship in response to the trajectory commands TRC for the X-axis direction translation, the Y-axis direction translation, and the Z-axis direction rotation that are appropriately given, and the behaviors of the required propulsion force operation amounts f and the required steering operation amounts θ required on this occasion in the first embodiment. In FIG. 7A, the time history of the ship behavior is shown. In part (a) of FIG. 7A, the X-axis direction translational motion is shown. In part (b) of FIG. 7A, the Y-axis direction translational motion is shown. In part (c) of FIG. 7A, the Z-axis direction rotational motion, and actual trajectories (X, Y, and γ) corresponding to the respective commands (X command, Y command, and γ command) are shown. In FIG. 7B, there are shown time histories of operation amounts required for the outboard engines at the time of the ship behaviors shown in FIG. 7A. In part (a) of FIG. 7B, the propulsion force operation amounts $f_1$ and $f_2$ required for the two outboard engines are shown, and in part (b) of FIG. 7B, the steering angle operation amounts $\theta_1$ and $\theta_2$ required for the two outboard engines are shown.

The trajectory generator 10 provides, as the trajectory commands TRC, trajectory commands satisfying such a condition that initial positions of the X-axis direction translational position and the Y-axis direction translational position are 0 m, an initial attitude of the Z-axis direction rotation is 0 degrees, terminal positions of the X-axis direction translational position and the Y-axis direction translational position are 100 m, and a terminal attitude of the Z axis is 45 degrees. As the restriction values, the propulsion force restriction is ±5,000 N, and the steering angle restriction is ±20 degrees.

From parts (a), (b), and (c) of FIG. 7A, it can be verified that all the actual trajectories X, Y, and γ follow the trajectory commands expressed as the X command, the Y command, and the γ command to terminal states. Moreover, from parts (a) and (b) of FIG. 7B, the propulsion force operation amounts $f_1$ and $f_2$ required on this occasion are within the restriction range of ±5,000 N, and the required steering angle amounts $\theta_1$ and $\theta_2$ are also within the restriction range of ±20 degrees, and it is verified that the motion control of the ship can be implemented with the operation amounts satisfying the constraint conditions of both the propulsion force and the steering angle.

In the steering angle operation amounts $\theta_1$ and $\theta_2$ of part (b) of FIG. 7B, such a phenomenon that the operation amounts quickly change can be observed. Those operation amounts are suspected to exert adverse effect on an outboard engine control system downstream of the motion control device 1 for a ship, but such quick changes can be handled by inserting a change amount restriction processor or an appropriate filter, for example, a moving average filter, at the subsequent stage of the operation amount calculator 270 as illustrated by a smoothing device 280 indicated by the broken lines of FIG. 4. The smoothing device 280 may be constructed so as to be integrated into the operation amount calculation part 270.

Second Embodiment

Figure 8:
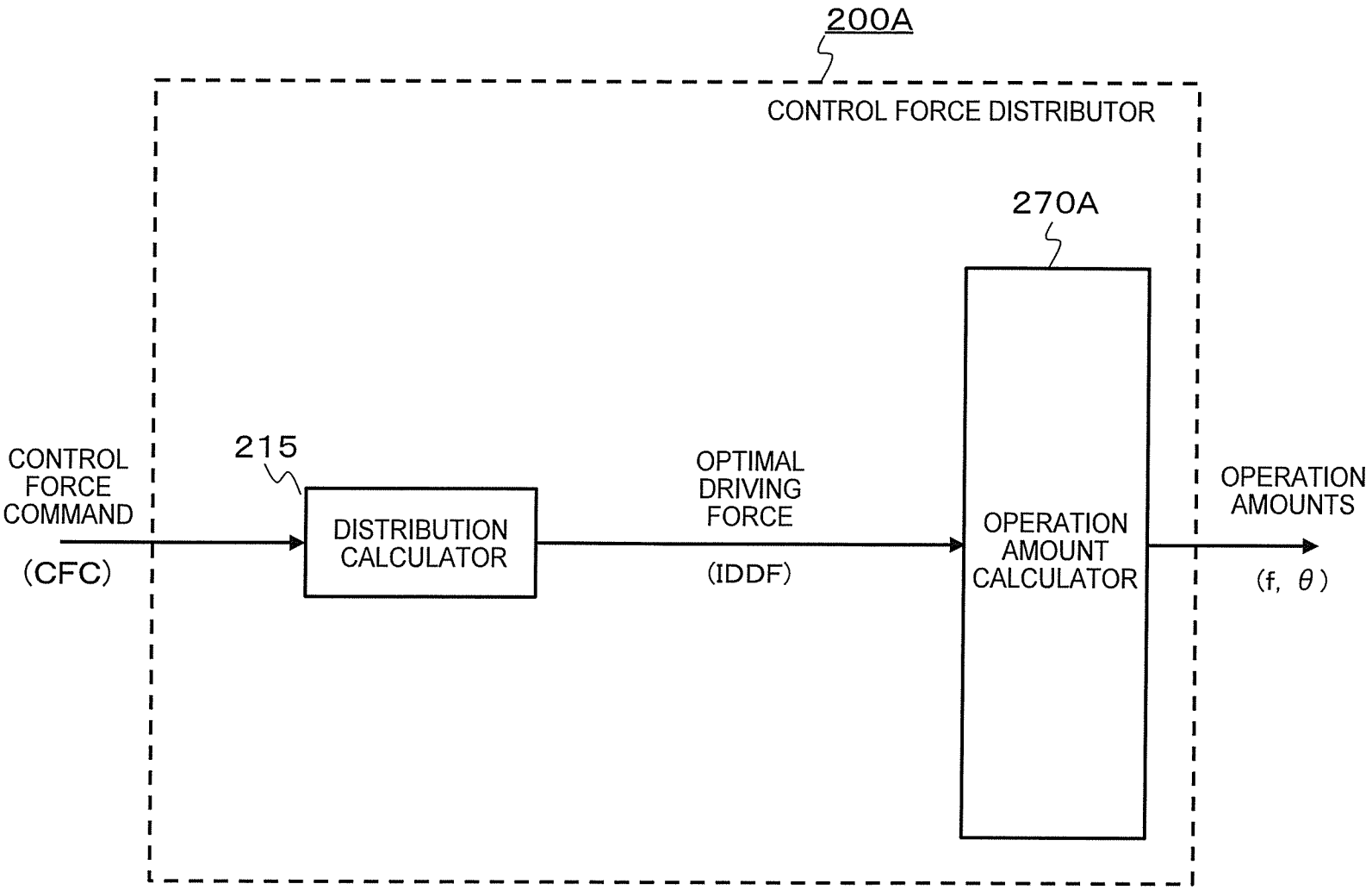
FIG. 8 is a diagram for illustrating an example of the configuration of the control force distributor of FIG. 1 in a second embodiment of the present invention.

FIG. 8 is a diagram for illustrating an example of a configuration of a control force distributor of a motion control device for a ship according to a second embodiment of the present invention. The other parts are basically the same as those of the first embodiment. In the first embodiment, the optimization calculation is carried out under the linear inequality constraint conditions corresponding to the respective four distribution calculators at the preceding stage of the driving force selector 250. In this case, when the number of the outboard engines is represented by n, the optimization calculation needs to be carried out under a total of 2n linear inequality constraint conditions. In the motion control device configured in this way, calculation cost increases twice as fast as the number of the outboard engines. Therefore, the calculation cost is preferably decreased as much as possible in order to complete the optimization calculation within a control cycle set in advance.

Thus, in the second embodiment of the present invention, in order to decrease the calculation cost as much as possible, a control force distributor 200A includes one distribution calculator.

A distribution calculator 215 is configured to input the control force commands CFC, and output the optimal driving force IDDF. On this occasion, in order to relax a condition serving as a base for defining the linear inequality constraint conditions for a positive/negative output of the propulsion force operation amount f required for the outboard engine, the optimization problem is transformed into another optimization problem having f as a free variable. Specifically, the propulsion force f is considered as a free variable, and a variable conversion is carried out as expressed as Expression (9).

$$f=f^{+}-f^{-} \tag{9}$$

In this expression, the following expressions are satisfied.

$f^{+}\geq 0$ $f^{-}\geq 0$

In accordance with this variable conversion, the propulsion force operation amount $f_X$ in the X-axis direction and the propulsion force operation amount $f_Y$ in the Y-axis direction are expressed as Expression (10).

$$\begin{cases} f_X = f\cos\theta = f^{+}\cos\theta - f^{-}\cos\theta = f_X^{+} - f_X^{-} \\ f_Y = f\sin\theta = f^{+}\sin\theta - f^{-}\sin\theta = f_Y^{+} - f_Y^{-} \end{cases} \tag{10}$$

The symbol in the expression is defined as follows.

θ: Steering angle of outboard engine

Next, the linear inequality constraint conditions in the two regions for each outboard engine illustrated in FIG. 6 are represented by Expression (11) in accordance with consideration similar to that for Expression (4).

$$AF'\leq b \tag{11}$$

The symbols in the expression are defined as follows.

A: Matrix

F': Vector constructed by free variables b: Vector

A solution F'* for minimizing Expression (12) of the performance function is calculated under the linear inequality constraint conditions of Expression (11).

$$J = \frac{1}{2}F'^{T}R'F' - f^{T}C'F' \tag{12}$$

In this expression, R' represents a positive semi-definite matrix, and is given by, for example, Expression (13).

$$R'=C'^{T}C'+\rho I' \tag{13}$$

Moreover, C' represents a matrix obtained when the C matrix in Expression (2) is expressed by free variable vectors, and I' represents a unit matrix.

From the above description, the distribution calculator 215 is configured to carry out optimization calculation of minimizing the performance function of Expression (12) under the linear inequality constraint conditions of Expression (11) to output the optimal driving force IDDF. In this way, the one distribution calculator is configured to carry out the optimization calculation without the plurality of distribution calculators for the optimization calculation in accordance with the combinations of the number of the outboard engines and the regions under the linear inequality constraint conditions for each region of the constraint as in the first embodiment.

The operation amount calculator 270A is configured to convert the optimal driving force IDDF, which is the output of the distribution calculator 215, into a propulsion force command and a steering angle command, which are actual operation amounts for the outboard engine, namely, the required propulsion force operation amount f and the required steering angle operation amount θ.

The driving force selector 250 is provided as illustrated in FIG. 4 in the first embodiment, but is not always necessary in the second embodiment. This is because the optimal driving force IDDF is obtained only as the output of the distribution calculator 215. However, as a matter of course, this configuration can be used for signal processing set in advance such as monitoring an error norm, and, for example, holding the optimal driving force IDDF to the previous calculation value when the error norm excessively increases. In this way, the failure of the control calculation can be suppressed.

As described above, according to the second embodiment, in addition to the effects of the first embodiment, the calculation cost of the optimization calculation can drastically be decreased.

Moreover, in all of the embodiments, change rate restriction processing, upper/lower limit processing, and filtering processing can be applied to the operation amounts, which are the outputs of the control force distributor. Further, the form of the controller may be applied not only to a classical control system, but also to a modern control system, which carries out the state feedback control, as a matter of course.

In the above-mentioned respective embodiments, the trajectory generator 10, the controller 100, and the control force distributor 200 of the motion control device 1 illustrated in FIG. 1, and further the control parts formed as respective functions illustrated in FIG. 2 to FIG. 4 and FIG. 8 for constructing those devices may be constructed by independent control circuits, or may uniformly be constructed by one control circuit.

Regarding this point, each of the processing circuits for implementing those functions may be constructed by dedicated hardware or a central processing unit (CPU, which is also referred to as processing device, calculation device, microprocessor, microcomputer, processor, or DSP) for executing a program stored in a memory.

Figure 9A:
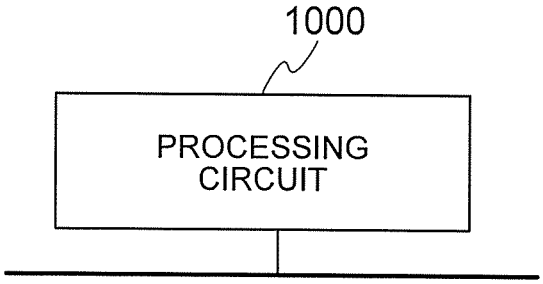
FIG. 9A and FIG. 9B are diagrams for illustrating examples of a hardware configuration of a control part of the motion control device for a ship according to the present invention.
Figure 9B:
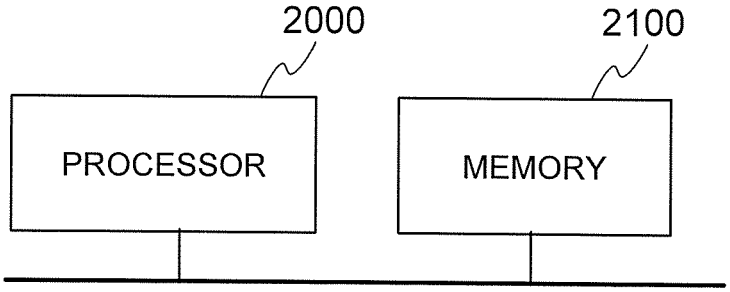

FIG. 9A and FIG. 9B are schematic illustrations of hardware configurations in a case where those functions are constructed by hardware and a case where those functions are constructed by software, respectively.

When the functions of the above-mentioned respective components are constructed by hardware illustrated in FIG. 9A, a processing circuit 1000 corresponds to, for example, a single circuit, a complex circuit, a programmed processor, a processor for a parallel program, an ASIC, an FPGA, or a combination thereof. The function of each component may be implemented by a processing circuit, or the functions of the components may altogether be implemented by a processing circuit.

When the functions of the above-mentioned respective components are constructed by a CPU illustrated in FIG. 9B, the functions of the respective components are implemented by software, firmware, or a combination of software and firmware. The software and the firmware are described as programs, and are stored in a memory 2100. A processor 2000, which is a processing circuit, is configured to read and execute the programs stored in the memory 2100 to implement the functions of the respective components. Those programs may be considered as programs for causing a computer to carry out the procedures and the methods of the respective parts. In this case, the memory 2100 corresponds to, for example, a nonvolatile or volatile semiconductor memory such as a RAM, a ROM, a flash memory, an EPROM, an EEPROM, and a magnetic disc, a flexible disk, an optical disc, a compact disc, a mini disc, a DVD.

The function of each component may be implemented partially by dedicated hardware, and partially by software or firmware.

In this way, the processing circuit can implement each of the above-mentioned functions by hardware, software, firmware, or a combination thereof.

Moreover, various types of information required for the processing are set to the circuit in advance in the case of the hardware configuration, and are stored in the memory in advance in the case of the software configuration.

What is claimed is:

1. A motion control device for a ship comprising a plurality of outboard engines, the motion control device causing the ship to cruise along a desired trajectory, and comprising:

a trajectory generator configured to output a trajectory command;

a controller configured to output a control force command based on the trajectory command and a sensor information group output from a sensor group provided for the ship; and a control force distributor configured to carry out, based on the control force command, optimization calculation for operation amounts required for the plurality of outboard engines in accordance with a constraint condition that is satisfied when an x-axis propulsion force operation amount is in a range from zero to a maximum propulsion force multiplied by a cosine value of a maximum steering angle, and a y-axis propulsion force operation amount is in a range from a negative value of the x-axis propulsion force operation amount multiplied by a tangent value of the maximum steering angle, to the x-axis propulsion force operation multiplied by the tangent value of the maximum steering angle.

2. The motion control device for the ship according to claim 1, wherein the control force distributor comprises:

a distribution calculator configured to output a driving force signal based on the control force command;

a driving force selector configured to output an optimal driving force signal based on the driving force signal; and an operation amount calculator configured to output the required operation amounts based on the optimal driving force signal.

3. A motion control device for a ship comprising a plurality of outboard engines, the motion control device causing the ship to cruise along a desired trajectory, and comprising:

a trajectory generator configured to output a trajectory command;

a controller configured to output a control force command based on the trajectory command and a sensor information group output from a sensor group provided for the ship; and a control force distributor configured to carry out, based on the control force command, optimization calculation for operation amounts required for the plurality of outboard engines in accordance with a constraint condition set in advance so as to output the operation amounts, wherein:

the control force distributor comprises a distribution calculator configured to output a driving force signal based on the control force command, a driving force selector configured to output an optimal driving force signal based on the driving force signal, and an operation amount calculator configured to output the required operation amounts based on the optimal driving force signal;

the plurality of outboard engines comprise a first outboard engine and a second outboard engine; and the distribution calculator is configured to calculate, as the driving force signal, a solution F* for minimizing a performance function J in a normal form given by the following expression under at least one linear inequality constraint condition:

$$J = \frac{1}{2}F^T RF - f^T CF$$

$$C \equiv \begin{bmatrix} 1 & 0 & 1 & 0 \\ 0 & 1 & 0 & 1 \\ L_y & -L_x & -L_y & -L_x \end{bmatrix}$$

$$f = \begin{bmatrix} X_f \\ Y_f \\ N_f \end{bmatrix}$$

$$F = \begin{bmatrix} f_{X1} \\ f_{X1} \\ f_{X2} \\ f_{Y2} \end{bmatrix}$$

where, in a body-fixed coordinate system, $X_f$ represents an X-axis direction translational force command, $Y_f$ represents a Y-axis direction translational force command, $N_f$ represents a Z-axis direction rotation torque command, $f_{X1}$ represents a propulsion force operation amount in an X-axis direction directed to the first outboard engine, $f_{Y1}$ represents a propulsion force operation amount in a Y-axis direction directed to the first outboard engine, $f_{X2}$ represents a propulsion force operation amount in the X-axis direction directed to the second outboard engine, $f_{Y2}$ represents a propulsion force operation amount in the Y-axis direction directed to the second outboard engine, R represents a positive semi-definite matrix, and $L_X$ and $L_y$ represent distances in the X-axis direction and the Y-axis direction, respectively, from a center of gravity of the ship to a rotation center of each of the first outboard engine and the second outboard engine.

4. The motion control device for the ship according to claim 3, wherein the driving force selector is configured to:

calculate an error norm given by the following expression for the driving force signal output from the distribution calculator:

$(f\text{–CF}^*)^T(f\text{–CF}^*)$; and carry out one of determining a solution $F_{opt}$ that minimizes the error norm to output the solution $F_{opt}$ as the optimal driving force signal and applying predetermined signal processing to the solution $F_{opt}$ in accordance with the error norm to output a result of the predetermined signal processing as the optimal driving force signal.

5. The motion control device for the ship according to claim 4, wherein the operation amount calculator is configured to calculate a propulsion force and a steering angle, which are the operation amounts required for the plurality of outboard engines, in accordance with the optimal driving force signal output from the driving force selector, and to output the propulsion force and the steering angle as the required operation amounts.

6. A motion control method for a ship that comprises a plurality of outboard engines to cruise along a desired trajectory, the motion control method comprising:

outputting a control force command based on a trajectory command and a sensor information group output from a sensor group provided for the ship; and carrying out, based on the control force command, optimization calculation for operation amounts required for the plurality of outboard engines in accordance with a constraint condition that is satisfied when an x-axis propulsion force operation amount is in a range from zero to a maximum propulsion force multiplied by a cosine value of a maximum steering angle, and a y-axis propulsion force operation amount is in a range from a negative value of the x-axis propulsion force operation amount multiplied by a tangent value of the maximum steering angle, to the x-axis propulsion force operation multiplied by the tangent value of the maximum steering angle.

* * * * *